US007775641B2

(12) United States Patent
Okazawa et al.

(10) Patent No.: US 7,775,641 B2
(45) Date of Patent: Aug. 17, 2010

(54) LIQUID EJECTING HEAD

(75) Inventors: Noriaki Okazawa, Shiojiri (JP); Takeshi Fujishiro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 583 days.

(21) Appl. No.: 11/842,788

(22) Filed: Aug. 21, 2007

(65) Prior Publication Data

US 2008/0043059 A1 Feb. 21, 2008

(30) Foreign Application Priority Data

Aug. 21, 2006 (JP) ..... 2006-223795

(51) Int. Cl.
*B41J 2/17* (2006.01)

(52) U.S. Cl. ..... 347/84

(58) Field of Classification Search ..... 347/84–87, 347/92, 93, 44

See application file for complete search history.

(56) References Cited

U.S. PATENT DOCUMENTS

2009/0233150 A1* 9/2009 Takahashi et al. ..... 429/34

FOREIGN PATENT DOCUMENTS

| | | |
|---|---|---|
| JP | 09-094978 | 4/1997 |
| JP | 11-020186 | 1/1999 |
| JP | 11-078046 | 3/1999 |
| JP | 11-227228 | 8/1999 |
| JP | 2002-355987 | 12/2002 |
| JP | 2004-284239 | 10/2004 |
| JP | 2005-186494 | 7/2005 |
| JP | 2006-069168 | 3/2006 |
| JP | 2006-142816 | 6/2006 |

* cited by examiner

*Primary Examiner*—Thinh H Nguyen
(74) *Attorney, Agent, or Firm*—Workman Nydegger

(57) ABSTRACT

There is provided a liquid ejecting head which can introduce a liquid in a liquid storage member to a pressure chamber side via a liquid flow path from a liquid introducing needle and which can eject a liquid in the pressure chamber from a nozzle opening as a liquid drop by operation of a pressure generator. The liquid introducing needle constructed in a hollow needle shape includes an introducing needle portion in which a liquid introducing through hole for introducing a liquid in the liquid storage member is opened, and a cylindrical enlarged diameter straight portion formed at the downstream side of the introducing needle portion and whose inner diameter is enlarged than the inner diameter of the introducing needle portion. The inner space of the enlarged diameter straight portion is to be a bubble chamber which can store a bubble and the enlarged diameter straight portion includes a groove portion extending from the upstream side toward the down stream side on the inner circumference surface.

4 Claims, 8 Drawing Sheets

LIQUID EJECTING HEAD

BACKGROUND

1. Technical Field

The present invention relates to an liquid ejecting head of an ink jet type recording head and the like, and in particular, to an liquid ejecting head for introducing a liquid stored in a liquid storage member to a pressure chamber via a liquid introducing needle and ejecting the liquid introduced into the pressure chamber from a nozzle opening as a liquid drop.

2. Related Art

As for a liquid ejection head for ejecting a liquid from a nozzle opening as a liquid drop by generating pressure fluctuation to a liquid in a pressure chamber, there are included, for example, an ink jet type recording head (hereinafter, simply referred to as a recording head) for used in an image recording apparatus such as an ink jet type recording apparatus (printer), a color material ejecting head for use in color filter manufacture such as a liquid crystal display, an electrode material ejecting head for use in electrode formation such as an organic EL (Electro luminescence) display and an FED (field emission display), a living organic matter ejecting head for use in bio chip (biochemical element) manufacture, and the like.

For example, in the above recording head, an ink in an ink cartridge is introduced into a pressure chamber side of the recording head via an introducing through hole opened at a distal end side of an ink introducing needle by introducing the ink introducing needle which is a type of a liquid introducing needle into the ink cartridge as a liquid storage member in which an ink in the form of liquid is enclosed. In addition, a structure has also been proposed in which the ink cartridge disposed at printer main body side and the ink introducing needle of the recording head are coupled with an ink tube and the ink in the ink cartridge is send into the recording head by a pump or the like.

In the recording head having the above structure, it is ideal that an ink flow path (liquid flow path) from the ink introducing needle to the nozzle openings of the recording head is filled with ink. However, it is difficult to completely prevent that bubbles are intruded into the ink flow path when, for example, ink is filled into the recording head (initial filling) or the like. The bubble intruded into the ink flow path is grown and enlarged with passage of time and when the bubble excessively grown is moved to the pressure chamber side by passing through a filter disposed in the mid-course of the ink flow path by the flow of the ink, there is a risk in that a disadvantage such as pressure loss caused when the bubble absorbs pressure fluctuation during ejecting operation, and shortage of supply of the ink caused when the bubble closes the flow path may be invited.

As a method for preventing such a disadvantage caused by a bubble, there is included a method for enhancing bubble discharging efficiency so that the bubble is prevented from remaining in the ink flow path as much as possible. As the method, for example, in JP-A-11-078046, a structure has been proposed in which a bubble guiding groove is provided on the inner circumference surface of the ink introducing needle near a filter (filter attached member) and the bubble in the ink flow path is positively introduced to the downstream side by the bubble introducing groove. At the same time, in JP-A-11-227228, a structure has been proposed in which the flow of the ink during initial filling is controlled by forming an ink introducing path on the inner circumference surface of the filter chamber formed at the proximal side of the ink introducing needle to improve bubble discharging property by pushing out the bubble to the downstream side by the ink.

Further, as a method different from the above described method, a conical shape bubble chamber (enlarged diameter portion) may be provided at the proximal sided of the ink introducing needle to positively store and keep the bubble in the bubble chamber, thereby preventing that the bubble is moved to the downstream side by passing through the filter by an ink flow velocity during normal recording operation (ejecting operation of ink drop). As for the example, in JP-A-2005-186494, a structure has been proposed in which a bubble interference member is to be disposed in the bubble chamber of the ink introducing needle to prevent that the bubble is moved to the filter side by the bubble interference member during recording operation.

However, a space of a portion functioning as the bubble chamber is not widely assured in each of the structures. Accordingly, when bubble is grown inside of the ink introducing needle, it is required to frequently perform cleaning operation for forcibly discharging ink and bubbles in order to prevent the ink flow path and filter is closed by the bubble. As a result, there was a problem in that ink is uselessly consumed.

In addition, in the case of the conical shape bubble chamber, when the size is to be enlarged in order to obtain a large inner space, the ink introducing needle is inevitably widen in the longitudinal and horizontal directions. This enlarges disposition intervals of the ink introducing needles. As a result, there arises an adverse effect such as a difficulty of downsizing the recording head.

SUMMARY

An advantage of some aspects of the invention is that it provides a liquid ejecting head which makes it possible to restrain consumption of a liquid by reducing execution number of cleaning operation.

According to an aspect of the invention, there is provided a liquid ejecting head which can introduce a liquid in a liquid storage member to a pressure chamber side via a liquid flow path from a liquid introducing needle and which can eject a liquid in the pressure chamber from a nozzle opening as a liquid drop by operation of a pressure generator. The liquid introducing needle constructed in a hollow needle shape includes an introducing needle portion in which a liquid introducing through hole for introducing a liquid in the liquid storage member is opened, and a cylindrical enlarged diameter straight portion formed at the downstream side of the introducing needle portion and whose inner diameter is enlarged than the inner diameter of the introducing needle portion. The inner space of the enlarged diameter straight portion is to be a bubble chamber which can store a bubble and the enlarged diameter straight portion includes a groove portion extending from the upstream side toward the down stream side on the inner circumference surface.

According to the structure, the ink introducing needle has a cylindrical enlarged diameter straight portion whose inner diameter is enlarged than the inner diameter of the introducing needle portion and the enlarged diameter straight portion is to be a bubble chamber which can store a bubble. Accordingly, by adjusting the size of the height direction (center axis direction) without changing the size of the side direction (direction perpendicular to the center axis direction) of the enlarged diameter straight portion when designing, a space for storing a bubble, that is, a growing allow portion of a bubble can be largely assured. Consequently, it becomes possible to store and keep a larger bubble in the enlarged diameter straight portion without inviting pressure loss and shortage of ink supply amount caused by the bubble. As a result, execution frequency of cleaning operation for forcibly discharging liquid and bubbles in the ink flow path from the nozzle opening can be reduced. Herewith, consumption of liquid due to cleaning operation can be restrained.

Further, the enlarged diameter straight portion has a groove portion extending from the upstream side toward the downstream side on the inner circumference surface, so that liquid can be smoothly flown to the downstream side (pressure chamber side) regardless of the size of the bubble.

In the above structure, it is preferable to employ a structure in which a narrowed potion is provided at the lower end of the groove portion so as to project from the inner surface side toward the center axis side of the enlarged diameter straight portion and so that the lower end of the grove portion is closed by the narrowed portion.

According to the structure, the bubble in the liquid introducing needle temporarily closes the liquid flow path at the position corresponding to the narrowed portion during cleaning operation for forcibly discharging liquid and bubbles in the liquid flow path from the nozzle opening. Herewith, pressure difference can be generated between the upstream side and the downstream side of the narrowed portion as a borderline. That is, the pressure of the downstream side than the narrowed portion can be temporarily lowered than the pressure of the upstream side. Then, by the pressure difference, the bubble can be swiftly flown to the downstream side. Herewith, the bubble can be efficiently discharged at short times than ever before. As a result, the ink amount consumed by one cleaning operation can be reduced.

Further, it is preferable to employ a structure in which a filter for filtering a liquid in the liquid flow path is disposed in a mid way of the liquid flow path and at the downstream side of the liquid introducing needle, a skirt portion whose diameter is gradually enlarged from the upstream side toward the downstream side is formed at the lower end of the enlarged diameter straight portion, and the liquid introducing needle is provided in the state where the lower opening of the skirt portion is opposed to the filter.

According to the structure, when it is necessary that the introducing needle portion of the liquid introducing needle is offset to the upstream opening of the ink flow path of the head side, the introducing needle portion to the enlarged straight portion can be offset to the upstream opening of the ink flow path at the head side. With the offset, it becomes not necessary to change the shape of the enlarged straight portion. Accordingly, in the case of the structure in which the liquid introducing needle having no offset shape and the liquid introducing needle having an offset shape are mixed, storage function of bubble can be uniformed for every ink introducing needle.

Further, it is preferable to employ a structure in which the enlarged diameter straight portion is continuously formed at the downstream side of the introducing needle portion via a tapered portion whose diameter is gradually enlarged from the upstream side toward the downstream side.

According to the structure, the introducing needle portion can be offset to the upstream opening of the ink flow path of the head side by changing the leaning of the side wall of the tapered portion without changing the shape of the enlarged straight portion.

BRIEF DESCRIPTION OF THE DRAWINGS

The invention will be described with reference to the accompanying drawings, wherein like numbers reference like elements.

FIG. 6A is a cross sectional view in the longitudinal direction of the needle, and FIG. 6B is a cross sectional view taken along the line VIB-VIB of FIG. 6A.

FIG. 8A shows a structure of a second embodiment, and FIG. 8B shows a structure of a third embodiment.

FIG. 9A shows a state during normal recording operation and FIG. 9B shows a state when a bubble is discharged during cleaning operation.

DESCRIPTION OF EXEMPLARY EMBODIMENTS

Hereinafter, best mode for carrying out the invention will be described with reference to the accompanying drawings. Various restrictions are placed on the embodiment described below as a preferable concrete example of the invention. However, note that the scope of the invention is not restricted to the illustrative embodiment unless there is a clear statement for restricting the invention. In addition, in the embodiment, an ink jet type recording head (hereinafter, referred to as a recording head) is used to explain a liquid ejecting head as an example.

Figure 1:
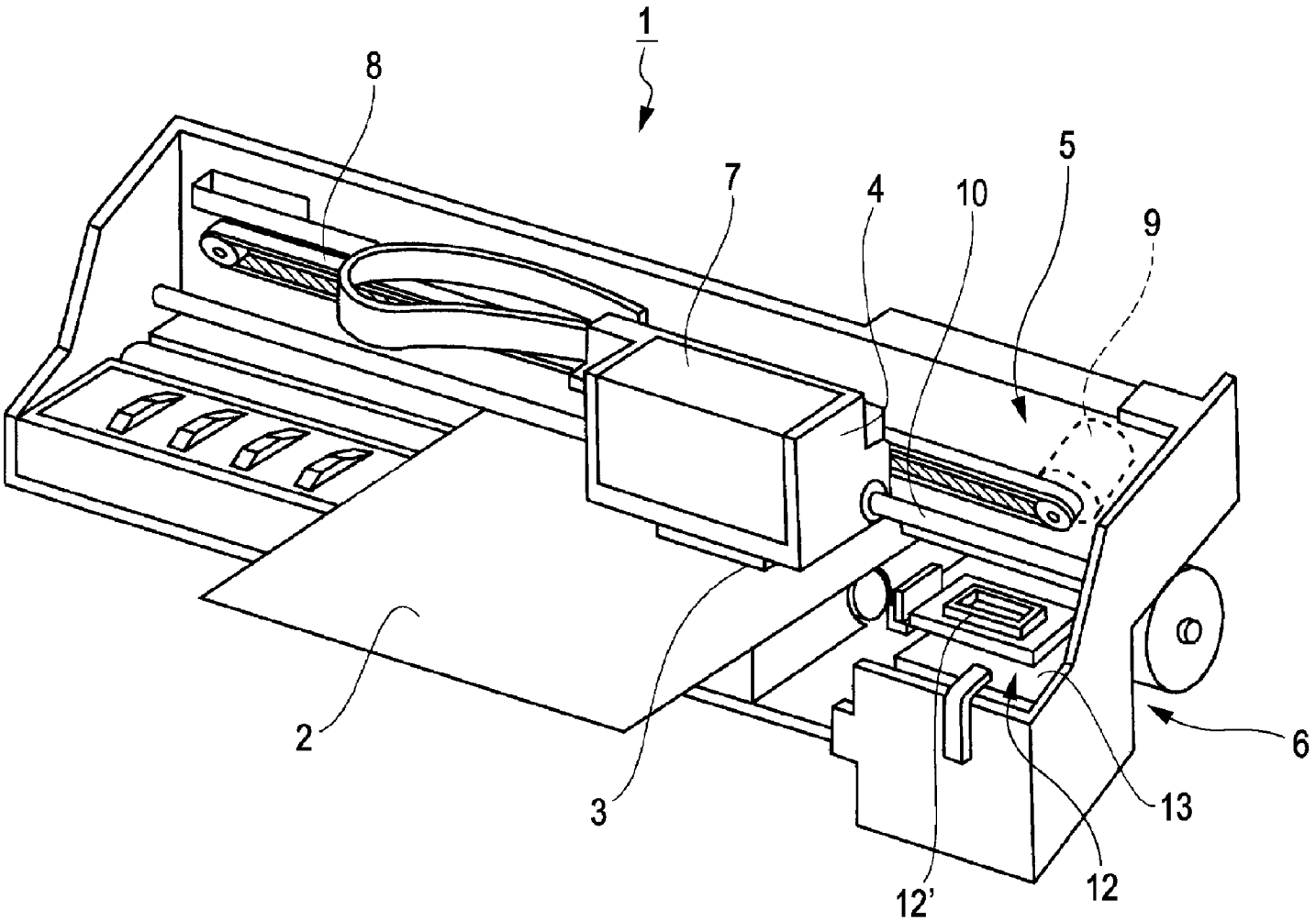
FIG. 1 is a perspective view illustrating a structure of a printer.

First, a structure of an ink jet type recording apparatus (a type of a liquid ejecting apparatus, hereinafter referred to as a printer) in which a recording head is mounted will be schematically described with reference to FIG. 1. The exemplified printer 1 is an apparatus for recording an image or the like by ejecting ink in the form of liquid on a surface of a recording medium (object to be ejected) such as a recording paper. The printer 1 is equipped with a recording head 3, a carriage 4 to which the recording head 3 is attached, a carriage moving mechanism 5 for moving the carriage 4 back and forth in a main scanning direction, a paper transporting mechanism 6 for transporting the recording medium 2 in a sub scanning direction (direction perpendicular to the min scanning direction), and the like. Herein, the ink describe above is a type of liquid in the invention and stored in an ink cartridge 7 (a type of liquid storage member). The ink cartridge 7 is attached to the recording head 3 in a detachable manner.

The carriage moving mechanism 5 is equipped with a timing belt 8 and the timing belt 8 is driven by a pulse motor 9 such as a DC motor. Accordingly, when the pulse motor 9 is operated, the carriage 4 is guided by a guide rod 10 provided to the printer 1 and moved back and forth in the main scanning direction (width direction of the recording paper 2).

A capping mechanism 12 is provided at a home position which is a non recording area of the printer 1. The capping mechanism 12 has a tray shaped cap member 12' which may be made contact with a nozzle forming surface of the recording head 3. In the capping mechanism 12, the space in the cap member 12' functions as a sealing space, and the capping mechanism 12 is constituted so as to be able to be attached firmly to the nozzle forming surface in the state where nozzle openings 26 of the recording head 3 (see FIG. 2) is placed in the sealing space. Further, a pump unit 13 is connected with the capping mechanism 12. By operating the pump unit 13, negative pressure can be applied in the sealing space. When the pump unit 13 is operated in a closely attached state on the nozzle forming surface and negative pressure is applied to the inner sealing space (enclosed space), the ink and bubbles in the recording head 3 are to be suctioned from the nozzle openings 26 to be discharged into the sealing space of the cap member 12'. That is, cleaning operation for forcibly suctioning and discharging the ink and bubbles in the recording head 3 (in an ink flow path) can be performed in the structure of the capping mechanism 12.

Figure 2:
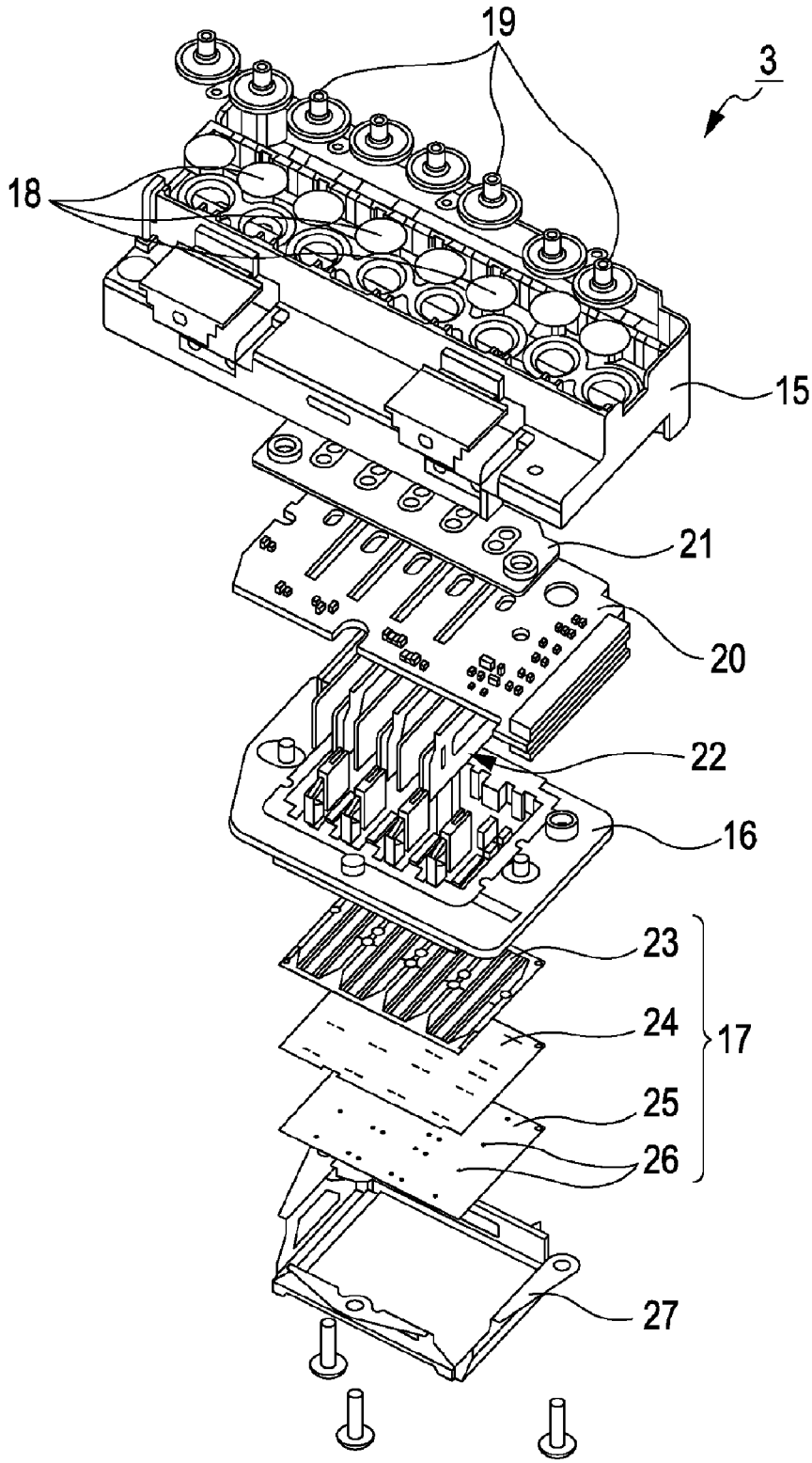
FIG. 2 is an exploded perspective view illustrating a structure of a recording head.
Figure 3:
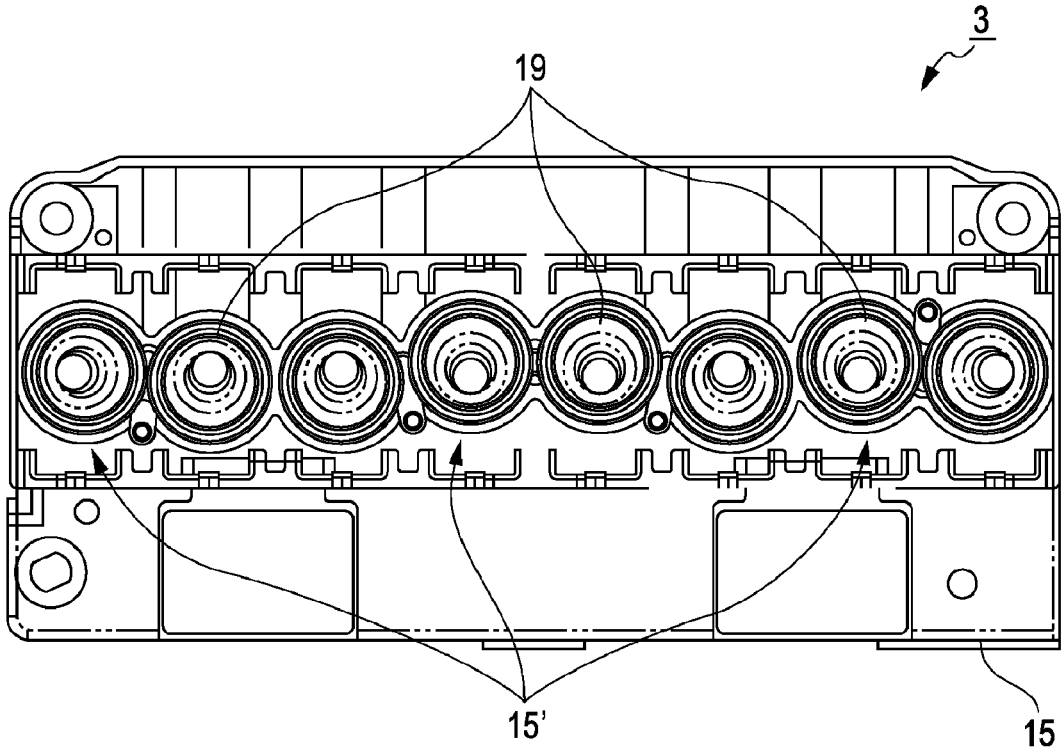
FIG. 3 is a plan view illustrating the structure of the recording head.
Figure 4:
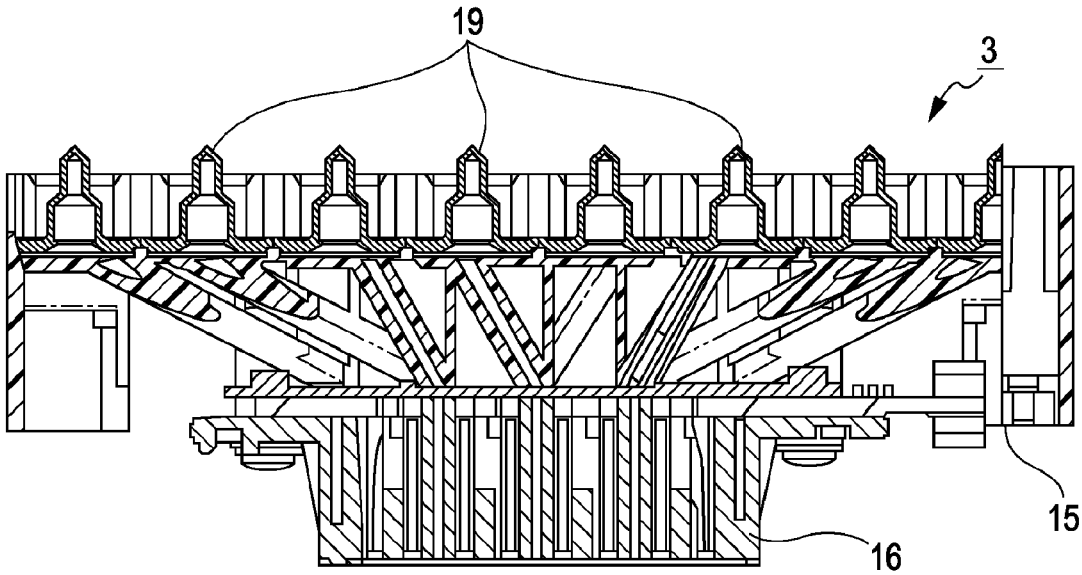
FIG. 4 is a cross sectional view illustrating an inner structure of the recording head.

Next, a structure of the recording head 3 will be described. Herein, FIG. 2 is a schematic exploded perspective view of the recording head 3, FIG. 3 is a plan view of the recording head 3, FIG. 4 is a cross sectional view of the recording head 3. The exemplified recording head 3 is schematically constituted by an introducing needle unit 15, a head case 16, a flow path unit 17, a vibrator unit 22, and the like.

The introducing needle unit 15 is formed, for example, by a synthetic resin and as shown in FIG. 3, a plurality of cartridge attached portions 15' are provided on the upper surface thereof. An ink introducing needle 19 (corresponding to a liquid introducing needle in the invention) is respectively attached to each cartridge attached portion 15' with a filter 18 intervened therebetween with the distal end thereof projected to the upper direction. Further, ink cartridges 7 stored various inks are attached to the cartridge attached portion 15'. When the ink cartridge 7 is attached to the cartridge attached portions 15', the ink introducing needle 19 is introduced into the inside of the ink cartridge 7. Herewith, an ink storage space in the cartridge and an ink flow path of the inside of the recording head 3 are communicated via ink introducing through holes 46 (see FIG. 6A) opened and provided to a pointed end 43 of the ink introducing needle 19 and the ink stored in the cartridge is introduced into the recording head 3 via the ink introducing through holes 46. Note that the type of the ink cartridge is not limited to the type in which the ink cartridge is attached to the carriage 4 as in the embodiment, and the type can also be employed in which the ink cartridge is attached to a housing side of the printer 1 and ink is supplied to the recording head side via an ink supplying tube.

A circuit substrate 20 is attached between the lower surface of the introduce needle unit 15 which is opposite side to the cartridge attached portion 15' and the upper surface of the head case 16 as shown in FIG. 2. The circuit substrate 20 is equipped with a circuit pattern for supplying a driving signal to, for example, a piezoelectric vibrator 30 (see FIG. 5), a connector for connecting to the printer main body side, and the like. The circuit substrate 20 is attached to the introducing needle unit 15 via a sheet member 21 functioning as a packing.

The head case 16 is a hollow box-like member for storing a vibrator unit 22 having the piezoelectric vibrator 30. A storage space 32 (see FIG. 5) which can storage the vibrator unit 22 is formed in the head case 16. The vibrator unit 22 is stored in the storage space 32 and fixed to the inner surface of the storage space 32 by adhesion or the like. A flow path unit 17 is fixed to the distal surface of the head case 16 opposite to the side of the attached surface of the introducing needle unit 15 by adhesive agent or the like. The flow path unit 17 is manufactured by bonding and integrating a vibration plate 23, a flow path forming substrate 24, and a nozzle plate 25 which are in a laminated state by an adhesive agent or the like.

The nozzle plate 25 is a member manufactured by a thin plate made of, for example, stainless. Fine nozzle openings 26 are formed in a line manner at a pitch corresponding to dot formation density of the printer 1. A head cover 27 is manufactured by a thin member made of, for example, metal and is attached to the distal end of the head case 16 so as to surround the peripheral border of the nozzle plate 25 from the outside. The head cover 27 protects the distal end of the flow path unit 17 and the head case 16 and has a function to prevent the charging of the nozzle plate 25.

Figure 5:
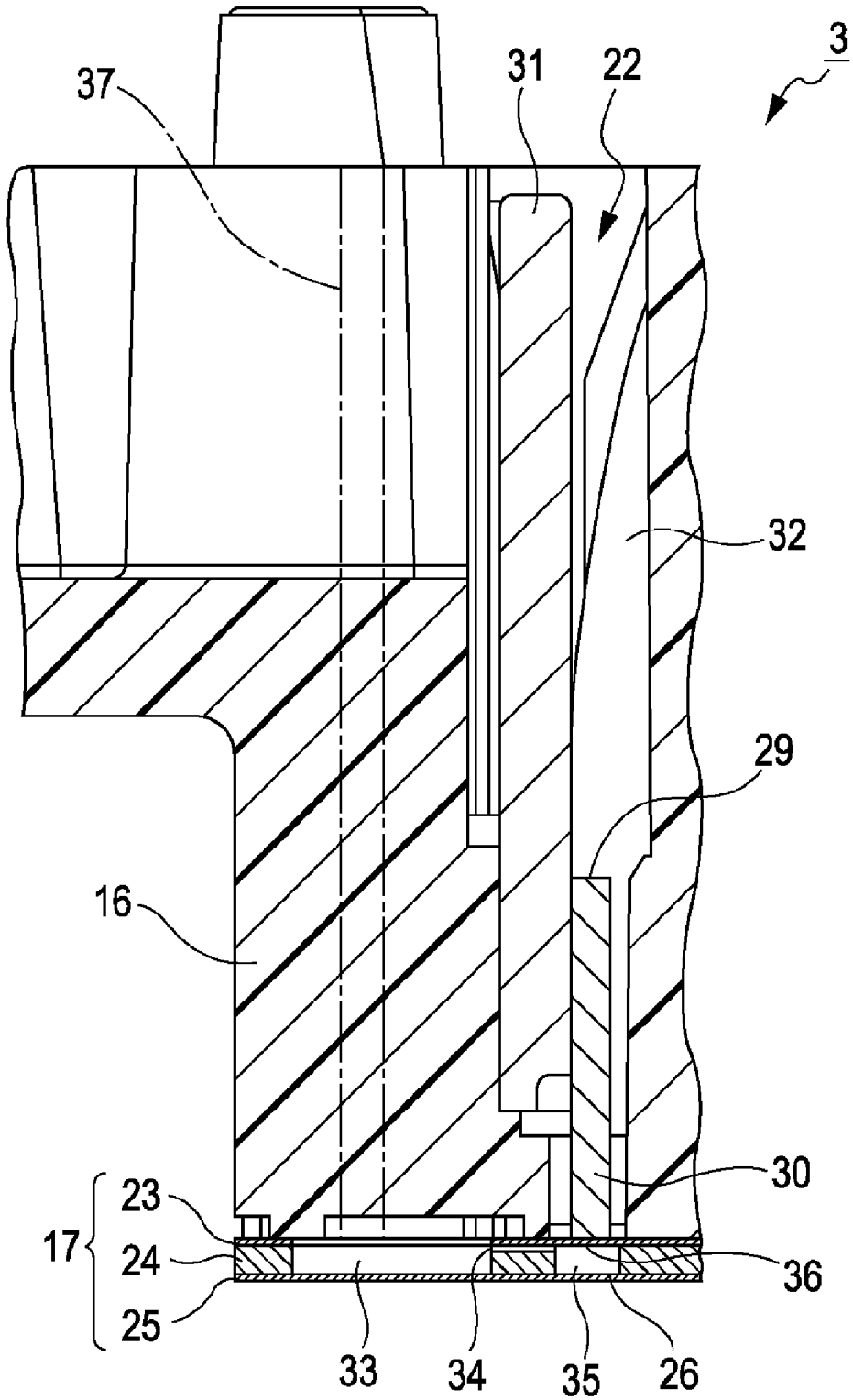
FIG. 5 is a partially cross sectional view illustrating the inner structure of the recording head.

FIG. 5 is a substantial part cross sectional view of the recording head 3. The vibrator unit 22 is constituted by a piezoelectric vibrator group 29 as a pressure generator, a fixing plate 31 to which the piezoelectric vibrator group 29 is united, a flexible cable (not shown) for supplying a driving signal to the piezoelectric vibrator group 29 from the circuit substrate 20, and the like. The piezoelectric vibrator group 29 of the embodiment is equipped with a plurality of piezoelectric vibrators 30 aligned and provided in a comb like manner. In each of the piezoelectric vibrators 30, a fixing end is united on the fixing plate 31 and a free end is projected to the outside than the distal surface of the fixing plate 31. That is, each of the piezoelectric vibrators 30 is attached on the fixing plate 31 in so-called a cantilever state. In addition, the fixing plate 31 for supporting each piezoelectric vibrator 30 is constituted by, for example, stainless steel having a thickness of about 1 mm. Note that except for the piezoelectric vibrator, an electrostatic actuator, a magnetostrictive element, a heater element, or the like can be used as for the pressure generator.

The flow path forming substrate 24 is a plate-like member in which a vacancy portion which become a common ink chamber 33, a plurality of grooves which become ink supplying openings 34 and vacancy portions which become pressure chambers 35 are formed so as to correspond to each nozzle opening 26 in the state where the vacancy portions and the grooves are separated by partition walls. The flow path forming substrate 24 is manufactured by, for example, subjecting etching process to a silicon wafer. The pressure chamber 35 is formed as a chamber elongated in the direction perpendicular to the aligned and provided direction (nozzle alignment direction) of the nozzle openings 26. In addition, the common ink chamber 33 is communicated with an ink introducing path 42 (ink flow path at ink introducing needle side, see FIG. 6A) of the ink introducing needle 19 via a head flow path 37 (ink flow path at head side) formed by passing through the head case 16 in the height direction, and is a chamber into which the ink stored in the ink cartridge 7 is introduced. Then, the ink introduced into the common ink chamber 33 is supplied to each pressure chamber 35 via the ink supplying opening 34.

The vibrator plate 23 is a composite board having a double structure in which an elastic film is subjected to a laminate process on a supporting plate made of metal such as stainless steel or the like. An island portion 36 for uniting the distal end of the free end of the piezoelectric vibrator 30 is formed at the portion corresponding to the pressure chamber 35 of the vibration plate 23 and the portion functions as a diaphragm portion. In addition, the vibration plate 23 seals the opening surface of one of the space which becomes the common ink chamber 33 and also functions as a compliance portion. The portion functions as the compliance portion is to be only the elastic film.

In the recording head 3, the island portion 36 is moved in the direction close to or apart from the pressure chamber 35 when the pressure piezoelectric vibrator 30 is elongated and contracted in the element longitudinal direction. Herewith, the capacity of the pressure chamber 35 is changed and pressure fluctuation is generated to the ink in the pressure chamber 35. By the pressure fluctuation, an ink drop (a kind of liquid drop) is ejected from the nozzle opening 26.

Next, a structure of the ink introducing needle 19 will be described.

Figure 6A:
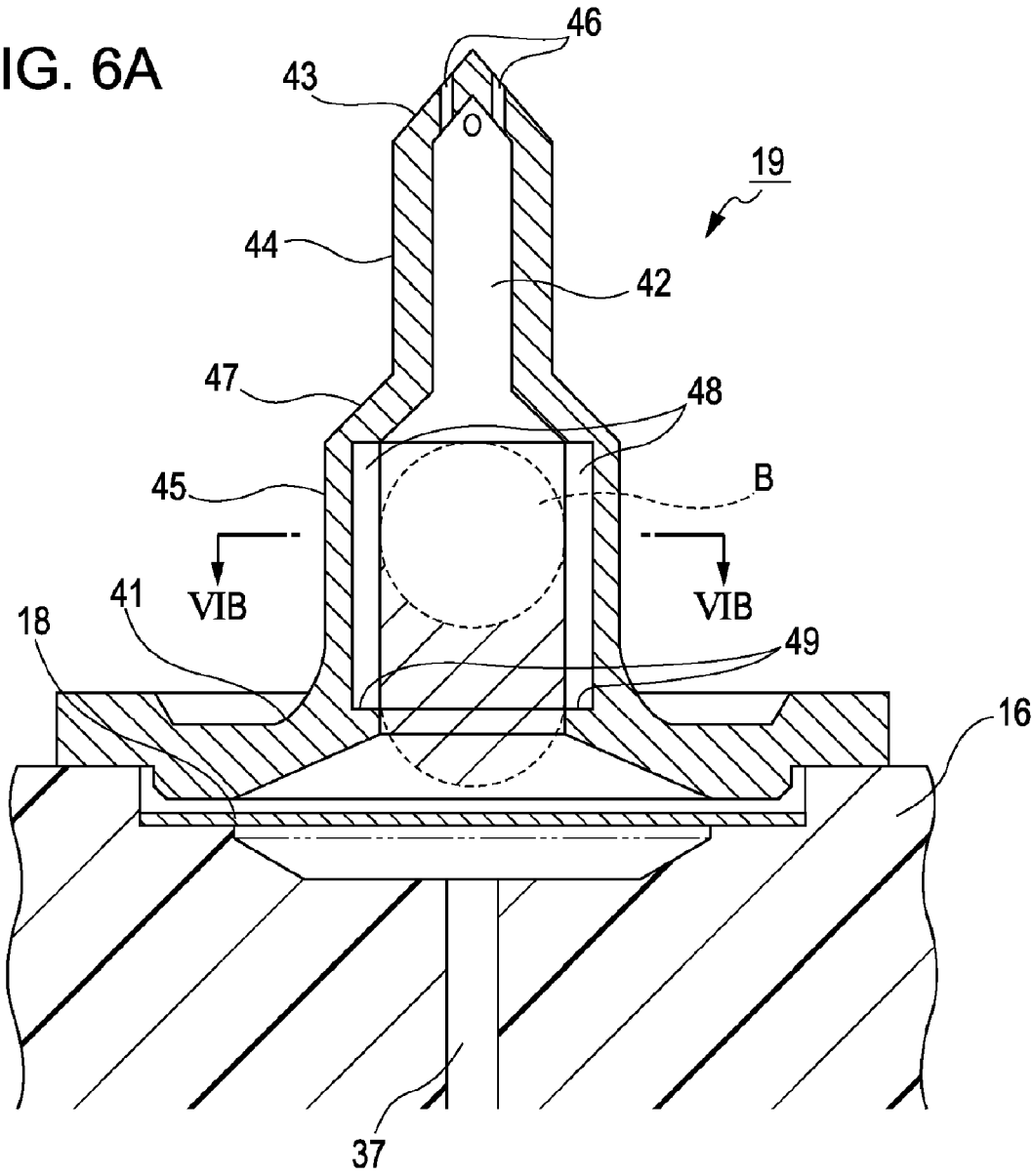
FIGS. 6A and 6B are each a cross sectional view illustrating a structure of an ink introducing needle.
Figure 6B:
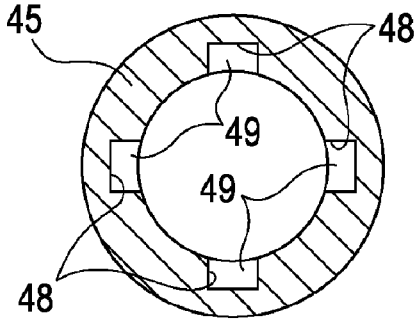

FIGS. 6A and 6B are each a diagram showing a structure of the ink introducing needle 19 of the embodiment, and FIG. 6A is a cross sectional view in the longitudinal direction of the needle, and FIG. 6B is a cross sectional view taken along the line VIB-VIB of FIG. 6A. The ink introducing needle 19 is a hollow needle-like member in which the inner space is to be the ink introducing path 42 and is schematically constituted by an introducing needle portion 44, an enlarged diameter straight portion 45, and a skirt portion 41.

The introducing needle portion 44 is a hollow cylindrical member inserted into the ink cartridge 7 and the conic shape pointed end 43 formed in a tapered shape is formed at the distal end thereof. A plurality of ink introducing through holes 46 (corresponding to the liquid introducing through hole of the invention) communicating an external of the ink introducing needle 19 with the ink introducing path 42 are opened and provided in the pointed end 43. That is, as described above, when the introducing needle portion 44 is inserted into the ink cartridge 7, the ink in the cartridge 7 can be introduced into the ink introducing path 42 via the ink introducing through holes 46. In the embodiment, a structure is exemplified in which the ink introducing through holes 46 are opened and provided in the pointed end 43. However, note that a structure can be employed in which, for example, the ink introducing through holes 46 are provided at the side surface of the introducing needle portion 44 positioned at the downstream side than the pointed end 43.

The enlarged diameter straight portion 45 is formed in a cylindrical shape continuously formed at the downstream side of the introducing needle portion 44 via a tapered portion 47 whose diameter is gradually enlarged from the upstream side toward the downstream side. The inner diameter of the enlarged diameter straight portion 45 is set larger than the inner diameter of the introducing needle portion 44 and the opening area thereof is set so as to be smaller than the valid filtration area (area in which ink can be actually passed through the filter 18) of the filter 18. Then, the inner space of the enlarged diameter straight portion 45 functions as a part of the ink introducing path 42 and also functions as a bubble chamber into which bubble B in the ink introducing path 42 can be stored as shown in FIG. 6A. The reason why the enlarged diameter straight portion 45 has a cylindrical shape whose cross sectional area is constant across the up and down is to grow the bubble B in the center axis direction (up and down direction) of the enlarged diameter straight portion 45 as shown in the hatching shown in FIG. 6A after the bubble B is grown to the degree at which the bubble B is made contact with the inner circumference surface of the enlarged diameter straight portion 45. Herewith, the capacity of the inner space of the enlarged diameter straight portion 45 can be effectively used as a growing allow portion in which the bubble B can be grown. Note that the bubble B is slightly pushed to the downstream side by the flow of the ink during normal recording operation, so that the bubble B is stayed at a position slightly apart from the inner circumference surface of the tapered portion 47 (enlarged diameter straight portion 45 side).

In addition, groove portions 48 each having a cross sectional rectangle shape extending toward the ink downstream direction on the inner circumference surface of the enlarged diameter straight portion 45. In the embodiment, as shown in FIG. 6B, four groove portions 48 in total are formed on the inner circumference surface of the enlarged diameter straight portion 45 so that the phases of the mutually adjacent grove portions 48 in the circumference direction are mutually different by 90 degrees. The groove portions 48 are provided as escape flow paths which make it possible to flow the ink to the downstream side even when the bubble B is grown to the degree at which the bubble B is made contact with the inner circumference of the enlarged diameter straight portion 45. Herewith, ink can be smoothly flown to the downstream side (pressure chamber side) without disturbed by the bubble B and it can be prevented that the bubble B is washed to the filter 18 side by the ink flow having an ink flow velocity during normal recording operation. Note that the shape of the groove portion 48 is not limited to the cross sectional rectangle shape and any shape, for example, such as a cross sectional half-moon shape may be employed as long as ink can be flown to the downstream side. Further, as for the numbers of the groove portion 48 to be formed, it is required to provide at least one.

In the embodiment, a narrowed portion 49 is provided at the lower edge of the groove portions 48, that is, the boundary portion between the enlarged diameter straight portion 45 and the skirt portion 45 so as to project toward the center axis side from the inner circumference surface side of the enlarged diameter straight portion 45. The distal surface of the enlarged diameter straight portion center axis side of the narrowed portion 49 is aligned to the inner circumference surface of the enlarged diameter straight portion 45 and the lower ends of the groove portions 48 are closed by the narrowed portion 49. With the structure, when the lower portion of the bubble B in the enlarged diameter straight portion 45 is reached to the position corresponding to the narrowed portion 49, the ink flow path (ink introducing path 42) is closed by the bubble B. The closed state of the ink flow path is intentionally generated so that the bubble B can be easily discharged during cleaning operation for forcibly discharging the ink and the bubble in the ink flow path of the recording head 3. The detail of the point will be described below.

The skirt portion 41 is continuously formed at the lower end of the enlarged diameter straight portion 45 and the diameter thereof is gradually enlarged from the upstream side toward the downstream side. The area of the upper end opening of the skirt portion 41 is aligned to the area of the lower end opening of the enlarged diameter straight portion 45, and on the other hand, the area of the lower end opening of the skirt portion 41 is aligned to the area of the valid filtration surface of the filter 18 disposed right under the lower end opening. Accordingly, the skirt portion 41 is constituted so that the ink and bubbles can be smoothly flown from the enlarged diameter straight portion 45 side toward the filter 18 side.

The ink introducing needle 19 is attached to the introducing needle unit 15 by, for example, ultrasonic adhesion in the state where the lower edge opening of the skirt portion 41 is opposed to the filter 18. Herewith, the ink introducing path 42 of the ink introducing needle 19 and the head flow path 37 at the head case 16 side are communicated in a liquid-tight manner. The ink introducing path 42 and the head flow path 37 function as the liquid flow path of the invention.

Incidentally, when, for example, the ink introducing needle 19 is inserted into and pulled out from the ink cartridge 7, air may be entered into the ink introducing path 42. Then, in the ink introducing path 42, small bubbles are combined to each other to be gradually grown to the big bubble B (see FIG. 6A). In the embodiment, the bubble B can be stored and kept in the enlarged diameter straight portion 45 in the state where the bubble B is floated on the upper side than the filter 18 by buoyancy applied to the bubble B without moving the bubble B to the pressure chamber side by passing through the filter 18 in a flow velocity during normal recording operation (during ejecting operation of ink drop) till the bubble B is grown to the degree at which the lower portion thereof is reached to the position corresponding to the narrowed portion 49. Further, in the printer 1, the bubble B stored in the enlarged diameter straight portion 45 is to be discharged by regularly performing cleaning operation by using the capping mechanism 12.

In the cleaning operation, the pump unit 13 is operated under the state where the cap member 12' is closely attached on the nozzle forming surface to generate an ink flow having several times of flow velocity during normal recording operation in the ink flow path, thereby discharging the bubble B in the enlarged diameter straight portion 45 from the nozzle opening 26 to the outside of the head by riding the bubble B on the ink flow. The suction conditions (suction power, suction time) of the pump unit 13 at the time is set by the conditions in view of the discharging property of the bubbles. From a view point of reducing the ink to be consumed by the cleaning operation as much as possible, it is preferable to set the timing for performing the cleaning operation between the time when the bubble B is grown to the degree at which the bubble B is made contact with the inner circumference surface of the enlarged diameter straight portion 45 and the time when the bubble B is grown to exceed the lower end of the enlarged diameter straight portion 45 and to reach in front of the filter 18 to be made contact with.

Herein, the ink introducing needle 19 has the cylindrical straight portion 45 and the inner space is to be a bubble chamber. Consequently, by adjusting the size of the height direction (axis direction) without changing the size of the side direction (direction perpendicular to the axis direction) of the enlarged diameter straight portion 45 when designing, a space for storing the bubble, that is, a growing allow portion of the bubble can be largely assured. Consequently, it becomes possible to keep the larger bubble B in the enlarged diameter straight portion 45 without inviting pressure loss and shortage of ink supply amount caused by the bubble. As a result, execution frequency of cleaning operation can be reduced, which makes it possible to restrain the consumption of ink due to cleaning operation. Further, the height of the enlarged diameter straight portion 45 is directly linked to the growing allow portion of the bubble B, so that there is an advantage in that the designing as for the storage amount of the bubble is easy as compared with the conventional conical shape bubble chamber. Further, it is not necessary to enlarge the size of the side direction of the ink introducing needle 19, so that it is possible to apply the ink introducing needle 19 having the above structure to the recording head having the conventional structure without changing the design of the recording head.

Further, the narrowed portion 49 is provided to the lower end portion of the groove portions 48 of the enlarged diameter straight portion 45 in the embodiment, so that the ink flow path is temporarily closed by the bubble B at the position corresponding to the narrowed portion 49 when the bubble B is discharged during cleaning operation. Herewith, pressure difference can be generated between the upstream side and the downstream side of the narrowed portion 49 as a borderline. That is, the pressure of the downstream side than the narrowed portion 49 can be temporarily lowered than the pressure of the upstream side. Then, when the pressure difference exceeds a certain value, the bubble B can swiftly be flown to the downstream side by using the pressure difference. Herewith, the bubble B becomes easy to path through the filter 18, so that the bubble B can be efficiently discharged at short times than ever before. As a result, the ink amount consumed by one cleaning operation can be reduced.

Next, differences of the invention and a conventional structure will be described with reference to FIG. 7.

Figure 7:
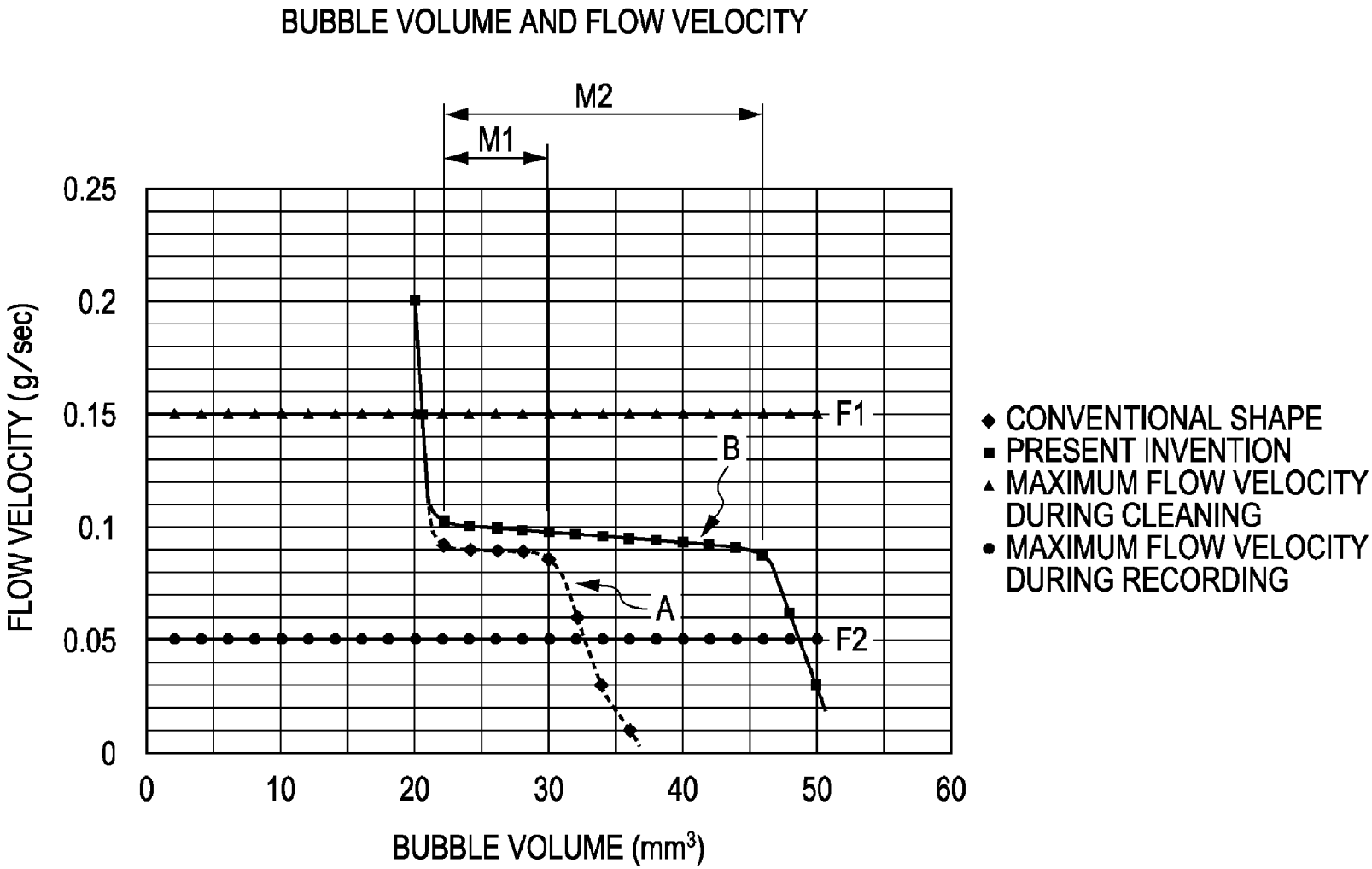
FIG. 7 is a graph showing a relation between the size of a bubble in a bubble chamber in the ink introducing needle and ink flow velocity.

FIG. 7 is a graph showing a relation between the size (volume) of the bubble in the bubble chamber of the ink introducing needle and ink flow velocity. In FIG. 7, the curve line shown by symbol A shows the relation in the case of a conventional conical shape bubble chamber, and the curve line shown by symbol B shows the relation in the case of the straight shape bubble chamber (enlarged diameter straight portion 45) of the invention respectively. Further, the straight line shown by symbol F1 shows the maximum flow velocity during cleaning operation and the straight line shown by symbol F2 shows the maximum flow velocity during normal recording operation (ejecting operation).

As shown in FIG. 7, when a bubble is begun to be formed in the bubble chamber from an ink filling time, the flow velocity of the ink is reduced with the formation and thereafter a flat portion in which change of the flow velocity with respect to the increase of the bubble volume is small appears in both of the conventional case and the case of the invention. That is, a flat portion in which the velocity is almost constant respectively appears in the range shown by M1 in the conventional case and by M2 in the case of the invention. When the volume of the bubble is in the ranges, the bubble can be stored and kept in the bubble chamber without providing negative influence to the ink amount to be supplied. In other words, the ranges shown by M1 and M2 show a growing allow portion which is an allowable range of bubble growth. When the volume of the bubble exceeds a constant value, the flow velocity is dramatically reduced. This is because the bubble closes the surface of the filter to disrupt the flow of the ink. In the conventional case, the allowable range M1 in which the bubble can be grown is relatively small, so that it is required to perform cleaning operation at short intervals. On the other hand, in the case of the invention, it is recognized the allowable range M2 can be largely assured. Accordingly, the execution number of cleaning operation can be reduced by an increased amount to the allowable range M1. As a result, the consumption amount of the ink can be restrained.

Next, another embodiments of the ink introducing needle 19 will be described.

Figure 8A:
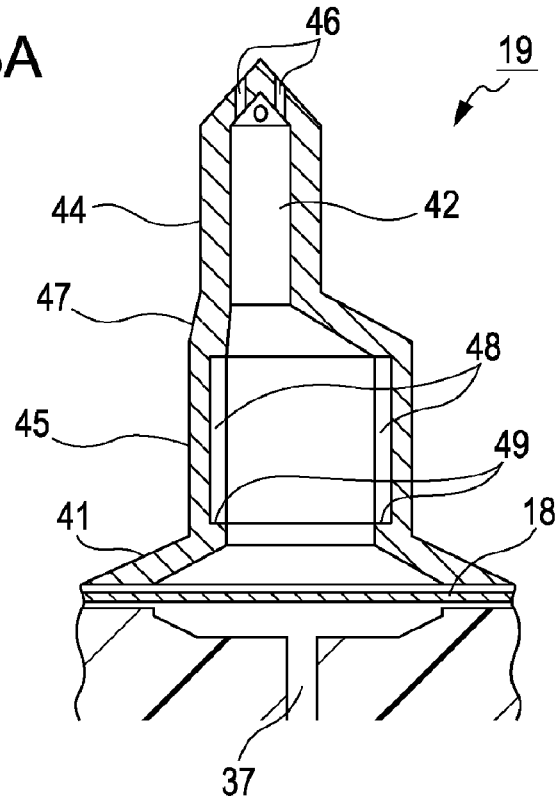
FIGS. 8A and 8*b* are each a cross sectional view illustrating a structure of an ink introducing needle according to another embodiment.
Figure 8B:
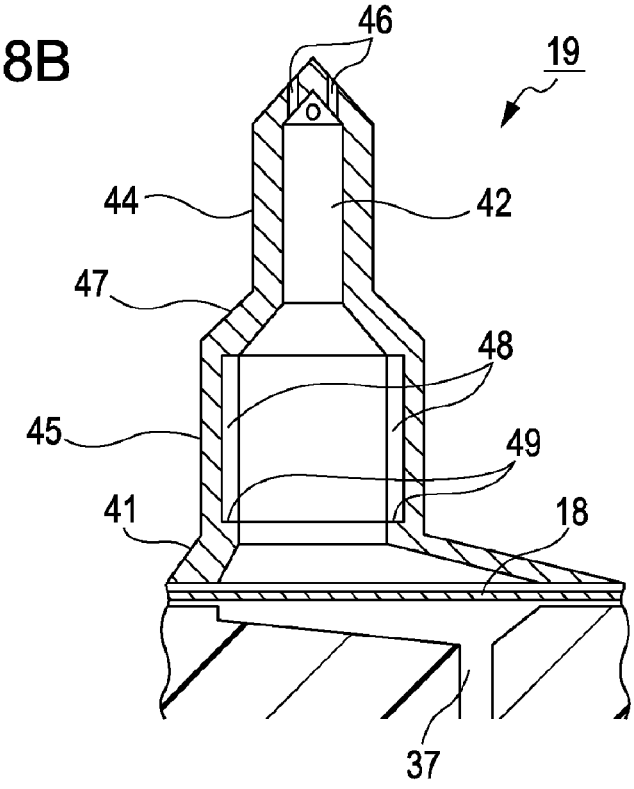

In the recording head 1, there is a case in that the introducing needle portion 44 is offset to the upstream opening of the head flow path 37 from the relationship between the disposed position of the ink cartridge and the upstream opening position of the head flow path 37 in the head case 16. In such a case, in the ink introducing needle 19, the introducing needle 44 can be offset to the upstream opening of the head flow path 37 by changing the inclination of the side wall of the tapered portion 47 as shown in a second embodiment shown in FIG. 8A. In addition, as in a third embodiment shown in FIG. 8B, the introducing needle portion 44 to the enlarged diameter straight portion 45 can be offset to the upstream opening of the head flow path 37 by changing the inclination of the side wall of the skirt portion 41. It is not necessary to change the shape of the enlarged diameter straight portion 45 by the offsets. Accordingly, in the case of the structure in which the ink introducing needle 19 having no offset shape and the ink introducing needle 19 having an offset shape are mixed, storage function of bubble can be uniformed for every ink introducing needle 19.

Figure 9A:
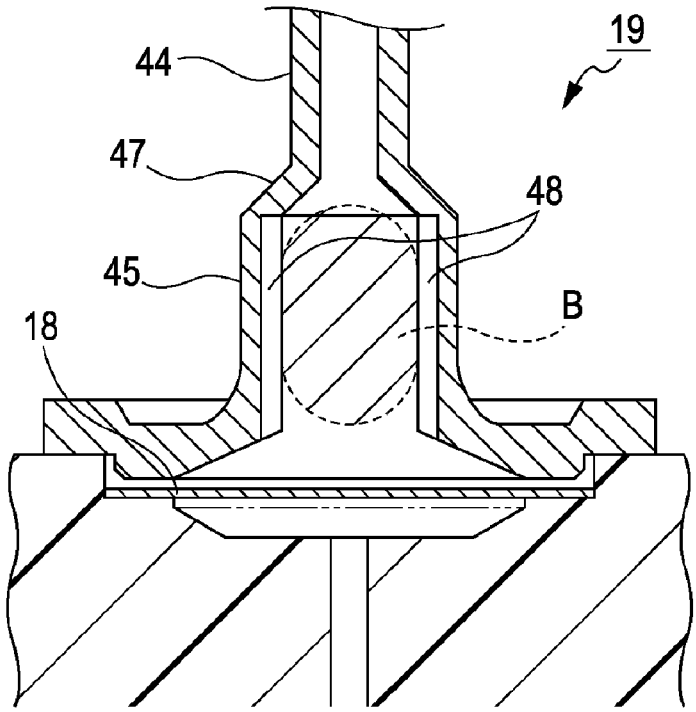
FIGS. 9A and 9*b* are each a diagram showing a structure of an ink introducing needle according to a fourth embodiment.
Figure 9B:
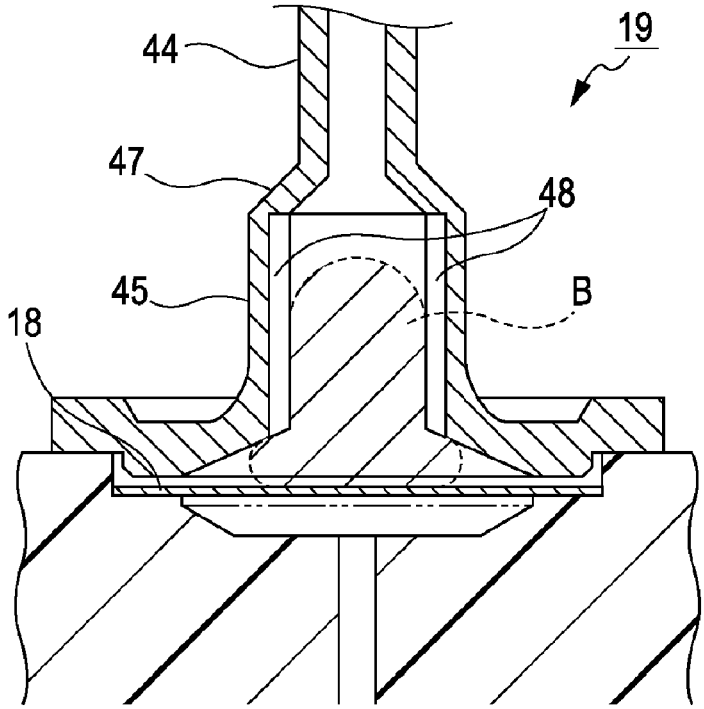

FIGS. 9A and 9*b* are each a diagram showing a structure of an ink introducing needle 19 according to a fourth embodiment. FIG. 9A shows a state during normal recording operation, and FIG. 9B shows a state when the bubble B is discharged during cleaning operation.

In the fourth embodiment, the point in which the narrowed portion 19 is not provided at the lower ends of the groove portions 48 is different from the above embodiments. A bubble can be discharged during cleaning without problems even when there is no narrowed portion 49 as in the embodiment and the bubble storage function of the enlarged diameter straight portion 45 of the embodiment is equivalent to that of the above described embodiment. Note that, in the embodiment, there is an advantage in that the ink introducing needle 19 can be integrally formed by injection because the lower end of the groove portions 48 are opened.

Though the recording head 3, a type of the liquid ejecting head, was described above as an example, the invention can also be applied to another liquid ejecting head having a liquid introducing needle. For example, the invention can also be applied to a color material ejecting head for use in color filter manufacture such as a liquid crystal display, an electrode material ejecting head for use in electrode formation such as an organic EL (Electro luminescence) display, and an FED (field emission display) a living organic matter ejecting head for use in bio chip (biochemical element) manufacture, and the like.

What is claimed is:

1. A liquid ejecting head which can introduce a liquid in a liquid storage member to a pressure chamber side via a liquid flow path from a liquid introducing needle and which can eject a liquid in the pressure chamber from a nozzle opening as a liquid drop by operation of a pressure generator, wherein the liquid introducing needle constructed in a hollow needle shape including, an introducing needle portion in which a liquid introducing through hole for introducing a liquid in the liquid storage member is opened, and a cylindrical enlarged diameter straight portion formed at the downstream side of the introducing needle portion and whose inner diameter is enlarged than the inner diameter of the introducing needle portion, and wherein the inner space of the enlarged diameter straight portion is to be a bubble chamber which can store a bubble and the enlarged diameter straight portion includes a groove portion extending from the upstream side toward the down stream side on the inner circumference surface.

2. The liquid ejecting head according to claim 1, wherein a narrowed potion is provided at the lower end of the groove portion so as to project from the inner surface side toward the center axis side of the enlarged diameter straight portion and so that the lower end of the grove portion is closed by the narrowed portion.

3. The liquid ejecting head according to claim 1, wherein a filter for filtering a liquid in the liquid flow path is disposed in a mid way of the liquid flow path and at the downstream side of the liquid introducing needle, a skirt portion whose diameter is gradually enlarged from the upstream side toward the downstream side is formed at the lower end of the enlarged diameter straight portion, and the liquid introducing needle is provided in the state where the lower opening of the skirt portion is opposed to the filter.

4. The liquid ejecting head according to claim 1, wherein the enlarged diameter straight portion is continuously formed at the downstream side of the introducing needle portion via a tapered portion whose diameter is gradually enlarged from the upstream side toward the downstream side.

* * * * *